US006523989B2

(12) United States Patent
Carty

(10) Patent No.: US 6,523,989 B2
(45) Date of Patent: Feb. 25, 2003

(54) FLOWABLE MATERIAL CONTAINER AND MIXING MAT

(76) Inventor: Eugene T. Carty, 5068 Warner Rd., Westerville, OH (US) 43081-9311

( * ) Notice: Subject to any disclaimer, the term of this patent is extended or adjusted under 35 U.S.C. 154(b) by 0 days.

(21) Appl. No.: 09/777,451

(22) Filed: Feb. 6, 2001

(65) Prior Publication Data

US 2002/0154834 A1 Oct. 24, 2002

(51) Int. Cl.[7] ..... B01F 13/00; B28C 5/44; B65D 69/00; B65D 25/02; B65D 30/00

(52) U.S. Cl. ..... 366/129; 206/219; 206/568; 383/4

(58) Field of Search ..... 366/129; 206/219, 206/568, 548; 383/4

(56) References Cited

U.S. PATENT DOCUMENTS

| | | | | |
|---|---|---|---|---|
| 699,589 | A | * | 5/1902 | Stoffel |
| 745,553 | A | * | 12/1903 | Allen |
| 977,129 | A | * | 11/1910 | Reynolds |
| 1,011,114 | A | * | 12/1911 | Button |
| 1,080,315 | A | * | 12/1913 | Allen |
| 1,629,723 | A | * | 5/1927 | Moler |
| D128,122 | S | * | 7/1941 | Lewis |
| D167,959 | S | * | 10/1952 | Stucker |
| 2,831,624 | A | * | 4/1958 | Lever |
| 2,839,762 | A | * | 6/1958 | Nomura |
| 2,908,020 | A | * | 10/1959 | Barton |
| 2,922,553 | A | * | 1/1960 | Wilson, III |
| 3,024,824 | A | * | 3/1962 | Bass |
| 3,680,772 | A | * | 8/1972 | Hoover |
| 3,934,999 | A | * | 1/1976 | Meier |
| 4,132,347 | A | | 1/1979 | Saito ..... 383/45 |
| 4,500,129 | A | * | 2/1985 | Hahn |
| 4,574,977 | A | * | 3/1986 | Ellis et al. |
| 4,952,073 | A | * | 8/1990 | Wieland |
| 5,048,975 | A | * | 9/1991 | Holbrook |
| 5,199,792 | A | * | 4/1993 | Roosa |
| 5,205,791 | A | * | 4/1993 | Pledger |
| 5,328,265 | A | * | 7/1994 | Cloney |
| 5,518,313 | A | * | 5/1996 | McAdam |
| 5,722,220 | A | * | 3/1998 | Greenland |
| 5,743,636 | A | | 4/1998 | Payne ..... 366/1 |
| 5,823,685 | A | | 10/1998 | Garlichs ..... 383/211 |

* cited by examiner

*Primary Examiner*—Tony G. Soohoo
(74) *Attorney, Agent, or Firm*—Sean M. Casey

(57) ABSTRACT

A storage and mixing apparatus for storing and mixing a substantially flowable substance that includes a container formed from a folded flexible sheet incorporating releasably sealed enclosure seams. The flexible sheet is unfoldable along a plurality of fold seams into a mixing mat, which has a basin portion. The mixing mat also includes a periphery that incorporates at least one releasably engagable basin former that is configured to form the periphery into a circumferential riser when the at least one basin former is engaged. The basin former can be incorporated into the periphery and may be formed with a raceway received with a cinch cord operative to form the riser when drawn. In the alternative, the periphery may be folded along the plurality of fold seams to form the riser from opposing walls. In this configuration, the at least one basin former can be adapted to releasably engage the opposing walls to form a basin from the basin portion and the opposing walls. In variations of the preferred embodiments, the opposing walls may be releasably engaged by the at least one basin former, which can incorporate any of a variety fasteners including hooks and loops, snaps, zippers, twist-lock posts adapted for receipt into corresponding holes, and adhesives. In other variations, the opposing walls can be marked with indicia that are calibrated to establish a predetermined quantity of the substantially flowable substance and which enable the user to confidently add and mix in a predetermined quantity of a second substance.

20 Claims, 3 Drawing Sheets

FLOWABLE MATERIAL CONTAINER AND MIXING MAT

TECHNICAL FIELD

This invention relates to a storage container adapted to store a flowable substance and to be reconfigured to form an apparatus that is adapted to manually mix the contents of the container with other substances.

BACKGROUND OF THE INVENTION

In the agricultural, building materials, and manufacturing fields, it has become standard practice to supply consumers of such materials with flowable substances contained in conveniently sized containers, including bags, that are adapted for ease of use, storage, transportation, and handling. Such containers and bags may be sized so that the consumer is not unduly burdened with a bag that is too heavy or too unwieldy in size to enable easy, single person use and movement. Most commonly, containers and bags of such materials may be sized so that the contents are apportioned into predetermined volumetric and/or weight ranges. For example, containers and bags of soil, seed, feed, or powdered cementitious materials may be made available, for example, in predetermined amounts of 20, 40, 80, 100, and 120 pounds, or in volumetric equivalents established in units of cubic feet and/or yards.

Such bulk agricultural materials include not only compost, soil, fertilizer, seed, feed, and powdered building materials such as cement and concrete, but can also include rice, wheat, barley, rye, coffee, soy, nuts, and other food stuffs that may be in any of a variety of forms including full grains, dehusked grains, crushed and dehusked grains, milled grains, and powdered grist. Other types of bulk building materials include cellulosic insulation, cementitious materials, and powered concrete and mortar compositions. In the manufacturing industry, many types of flowable substances are made available in various sized containers and bags. Such substances include, for example, plastic pellets and additives used for plastic injection molding, abrasives used in polishing and abrading applications, chemical compositions and substances (including, for example, soaps, bleaches, chlorine, salts, and other fluid treatment compounds), powdered metals and additives for use in powder metallurgy applications, and powdered lubricants, just to name a few. In yet other applications, the present invention is also compatible for use with gelatinous materials such as what is commonly referred to as naval jelly, which is used for removing rust and other corrosion products from metal surfaces. In this latter example, the storage and mixing apparatus according to present invention can be configured to store and transport the gelatinous, substantially flowable substance, and to be reconfigured into a treatment basin for treating the corroded parts with the naval jelly. This latter configuration is also compatible for use in military environments that use any of a variety of biological, chemical, and radiation decontamination bulk materials. Here again, the substantially flowable bulk substance or material can be easily stored and handled within the container, and then exposed as the container is unfolded and reconfigured into a treatment basin, wherein soldiers and other personnel may step into or place objects into the basin for decontamination of the apparel, work, and combat gear that may have been exposed to biological, chemical, and nuclear warfare hazardous materials.

In all applications that involve flowable substances, there is often a need to mix the flowable contents of the container or bag with another material, substance, or composition before use. In yet other applications, there is a need to treat objects with or expose them to the substantially flowable substance or bulk material. Often times, there is no readily available mixing apparatus to facilitate easy and convenient mixing or a treatment basin. This is particularly true for consumers of, for example, small quantities such as 1, 2, or 3 containers or bags of the flowable substance. For purposes of illustration, a consumer of grass seed may need to mix the seed with a fertilizer before application to a lawn; a consumer of corn feed stock may need to mix it with an antibiotic and a nutritive additive before feeding livestock; rice may need to be mixed with water before cooking; flour or wheat may need to be mixed with sugar and baking soda before adding water; concrete, mortar, or cement may need to be mixed with water before transfer of the mixture to a mold; color pigments may need to be added to the plastic pellets before transfer to a molding machine; and special alloying materials may be added to the base metal powder before forming, sintering, and extrusion. As those with skill in the art can appreciate, this list includes many other applications.

In all such applications, there has long been a need to provide the consumer with an easy to use, inexpensive, and convenient means for not only storing and handling such flowable substances, but also for mixing the substances. This is especially true for situations where only a small quantity of the flowable substance is to be consumed and use of large, automated mixing machines is inefficient and economically unwarranted. This can be true in applications where a container or bag of flour is to be mixed and prepared for distribution and cooking in an emergency aid environment, where help is rendered to victims of an earthquake, flood, or famine, and where mixing equipment for foodstuffs may not be available. This can also be true for small factories that employ only limited use of powder metallurgy technology or plastic injection molding applications. It is also true for consumers engaged in preparing small quantities of concrete, cement, grout, mastic, or mortar for use in constructing, for example, small garden stone walls, walkways, or footings for fence posts.

In each of the noted applications and situations, cumbersome and expensive automated mixing equipment is generally unjustifiable. Some attempts have been made to address the need for an improved means for storing, handling, and mixing flowable substances. One such attempt at improving the state of the art of mixing devices has been described in U.S. Pat. No. 5,743,636 to Payne. However, Payne's invention is limited to a sheet of flexible material arranged with a planar skirt that surrounds a basin having a bottom that is below and parallel to the skirt. Payne does not disclose any means of folding or otherwise adapting his device for storage of the dry ingredients he contemplates therein. Moreover, to actually function for its intended purpose, Payne's mixing mat is necessarily limited to being formed from a flexible sheet of material to include a basin with integrally formed vertical sides. It also includes an integrally formed skirt, which does not have compatibility with and which is not an efficient configuration for many of the applications and situations present in the myriad preceding examples.

What has been needed but heretofore unavailable, is an apparatus that not only easily accommodates a wide variety of mixing applications, but which can also be adapted without undue burden to facilitate storage, transfer, and handling of various flowable substances in a cost-effective and easy to use manner. Moreover, the preferred apparatus should be easily adapted to perform well with any of the aforementioned substances and in all of the attendant mixing situations described above and contemplated herein.

The present invention meets these and other needs without adding any complexity, inefficiencies, or significant costs to storage, handling, and mixing of widely available bulk materials and flowable substances such as and including those mentioned above. The various embodiments of the present invention disclosed herein are readily adapted for ease of manufacture, low fabrication costs, and immediate compatibility with both the container filling equipment and flowable substances presently in use.

SUMMARY OF INVENTION

In its most general sense the present invention overcomes the shortcomings of the prior art in any of a number of generally effective configurations. In one of the preferred embodiments this invention includes a storage and mixing apparatus for storing and mixing a substantially flowable substance that is formed from a folded flexible sheet. The flexible sheet is adapted to unfold along a plurality of fold lines into a mixing mat formed with a basin portion. The mixing mat is also formed to have a periphery incorporating at least one releasably engagable basin former.

Preferably, the basin former is configured to form the periphery into a circumferential riser that surrounds the basin portion when the former is engaged. The basin former can be incorporated into the periphery and can incorporate a raceway that is received with a cinch cord or draw string that is operative to form the riser or a surrounding, raised wall when drawn. In the alternative, the periphery may be folded along the plurality of fold seams to form the riser from opposing walls.

In this preferred configuration, the at least one basin former can be adapted to releasably engage the opposing walls to form a basin from the basin portion and the opposing walls. In variations of the preferred embodiments, the opposing walls may be releasably engaged by the at least one basin former. The former may incorporate any of a variety fasteners, such as, for example, hook and loop fasteners such as Velcro® by DuPont, metal or plastic snaps or zippers, twist-lock posts adapted for receipt into corresponding holes, and adhesives that may be applied directly to the sheet surface or in the form of adhesive strips that are glued in place.

In other variations and modifications of the preferred embodiments, the riser wall and opposing walls can be marked with indicia that are calibrated to establish predetermined weight and/or volumetric quantities of the substantially flowable substance, and any added substances. Such markings enable the user to add one or more additional substances to the basin so that a properly proportioned mixture can be obtained. For purposes of mixing the contents of the basin, the periphery also may include one or more handles formed from apertures incorporated into the outer edge of the periphery, or otherwise attached thereto by adhesives, rivets, thermal welds, and some other equally suitable fastening means.

The present invention also contemplates a preferred embodiment that includes a storage and mixing apparatus having a container that is formed almost entirely from a flexible sheet, which also operates as a mixing mat. In the container configuration, the flexible sheet is folded about a plurality of fold seams to create releasably sealable enclosure seams such that the container is adapted to store and contain the substantially flowable substance. The container configuration can be transformed by simply releasing the sealed seams, and by then unfolding the folded flexible sheet into its mixing mat configuration. This can be accomplished with the substantially flowable substance still contained within the bounds of the flexible sheet.

In yet other preferred embodiments, a storage and mixing apparatus is possible that is adapted for storing and mixing a first substantially flowable substance with a second substance. Here, the apparatus includes a container formed with a moisture barrier that is configured to contain the first substance. Also included, is a folded flexible sheet that is removably contained within the container. The sheet is formed with a basin portion and is adapted to unfold along a plurality of fold seams into a mixing mat that includes a periphery having at least one releasably engagable basin former. The periphery of the sheet is adaptable to form a riser when the at least one basin former is engaged. In variations of this embodiment, the container is imprinted with one or more indicia that are calibrated to measure a predetermined quantity of the second substance received therein. The indicia may be calibrated to measure the second substance before removal of the first substance from the container so as to measure the combination, or to measure the second substance after removal of the first from the container.

In a variation of any of the preceding embodiments, the container may also further incorporate an outside covering. In this modification, the flexible sheet is folded and arranged to be removably retained within an interstice formed between the moisture barrier of the container and the outside covering.

In another modification of the preceding preferred embodiments, a storage and mixing apparatus for storing and mixing a substantially flowable substance incorporates a container that is formed to include a moisture barrier that is adapted to contain a predetermined amount of the substantially flowable substance. The apparatus further incorporates a folded removable sheet that removably and substantially conforms to the container profile, either inside or outside the moisture barrier. The sheet is also adapted to unfold along a plurality of fold seams into a mixing mat that is formed with a basin portion and a periphery. The periphery preferably also includes at least one basin former that is, in essence, a fastener adapted to, when engaged, form the periphery into a circumferential riser.

Similar to preceding embodiments and variations thereof, the basin former can be integrally incorporated in the periphery to form a raceway that receives a circumferential drawstring or a cinch cord, which is operative to form the riser when drawn. Alternatively, the plurality of fold seams are adapted so the periphery is foldable into opposing walls that form the riser. In this alteration, the at least one basin former is preferably adapted to releasably engage the opposing walls to form a basin from opposing walls and the basin portion. In this alteration, the at least one basin former that is incorporated into the periphery is further formed with a raceway that receives a circumferential drawstring or a cinch cord.

As already described, these alterations may further include any of a variety of indicia for calibrated additions of other substances to the flowable substance, and the basin formers may be selected from any of a number of fastener types. These variations, modifications, and alterations of the various preferred embodiments may be used either alone or in combination with one another as will become more readily apparent to those with skill in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures, wherein like reference numerals across the several drawings, figures, and views refer to identical, corresponding, or equivalent elements, features, and parts:

DESCRIPTION OF THE PREFERRED EMBODIMENT

The storage and mixing apparatus of the instant invention enables a significant advance in the state of the art of containers that are adapted for storing and mixing substantially flowable substances. The preferred embodiments and described modifications of the storage and mixing apparatus accomplish this by new and novel arrangements of elements that are configured in unique and novel ways and which demonstrate previously unavailable capabilities.

Figure 1:
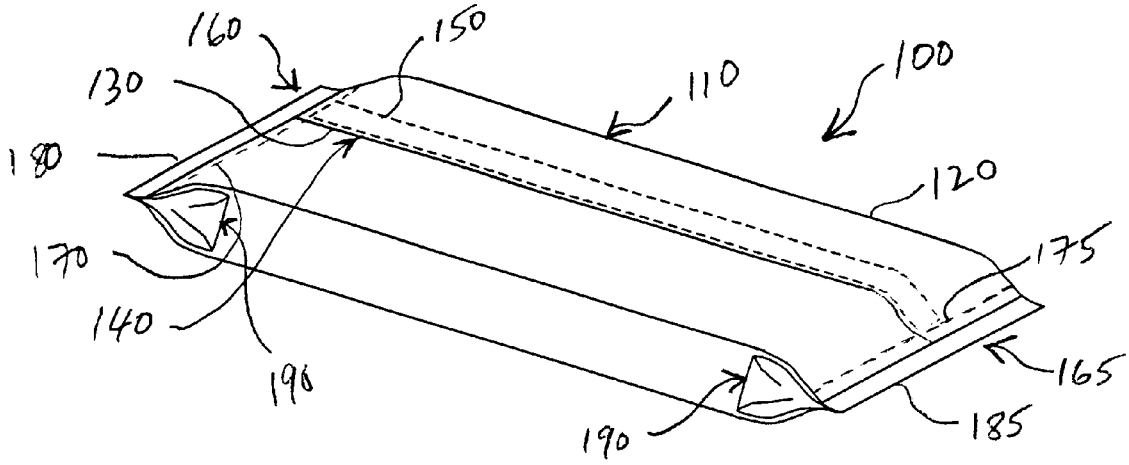
FIG. 1 is an elevated perspective view, in reduced scale, of a storage and mixing apparatus according to the present invention and configured as a container for storing a substantially flowable substance.

With reference now to the accompanying figures and specifically to FIG. 1, a storage and mixing apparatus 100 is shown that is configured for storing and mixing a substantially flowable substance (not shown). As represented in FIG. 1 and subsequent figures, the apparatus 100 is not shown to scale but is shown in one of many possible and equally desirable representative dimensional proportions, as will be apparent to those with skill in the art. The apparatus 100 incorporates an enclosed container 110 that is formed from a folded flexible sheet 120 joined at seam edges, including edge 130, by releasably sealed enclosure seams, including enclosure seam 140, which incorporate a seal such as seam seal 150. The seam seal 150 may incorporate a releasable thermal weld, an adhesive, or both, as is described in more detail below. As shown in FIG. 1 for purposes of illustration but limitation, the container 110 is formed in the general shape of a bag that is closed at its ends 160, 165 by end seals 170, 175 or end strips 180, 185 or both. For improved strength and durability, the ends 160, 165 of the container 110 preferably include inwardly folded portions 190, as shown in more detail in any of a number of prior U.S. Patents including, for example without limitation, U.S. Pat. No. 4,132,347, which is incorporated herein by reference in its entirety.

The flexible sheet 120 is preferably formed from durable paper, plastic, or cloth material, or a combination thereof, which is selected for optimum compatibility with the flowable substance to be contained within container 110. More preferably, the flexible sheet 120 is selected from a range of plastics such as, for example, polyethylene, polypropylene, and vinyl materials, or combinations thereof, that are adapted to provide an adequate moisture barrier, when needed and desirable, that is effective to prevent absorption of moisture by flowable substances that may be detrimentally hygroscopic or easily oxidized. For example, cementitious materials may absorb enough humidity and water so as to prematurely harden and/or cure. Certain powdered metal materials may oxidize and become incapable of sintering. In another example, dried food stuffs and animal feed may absorb moisture and decompose, and seed products may absorb enough moisture to prematurely bud and sprout. For high density materials such as cementitious and metal powders, a high-strength and durable moisture resistant flexible sheet material 120 such as a polypropylene plastic is selected, which has a thickness of preferably approximately between 3 and 10 mils (a mil is a thousandth or 0.001 of an inch), and more preferably between about 5 and 9 mils, and most preferably between about 6 and 7 mils.

Figure 2:
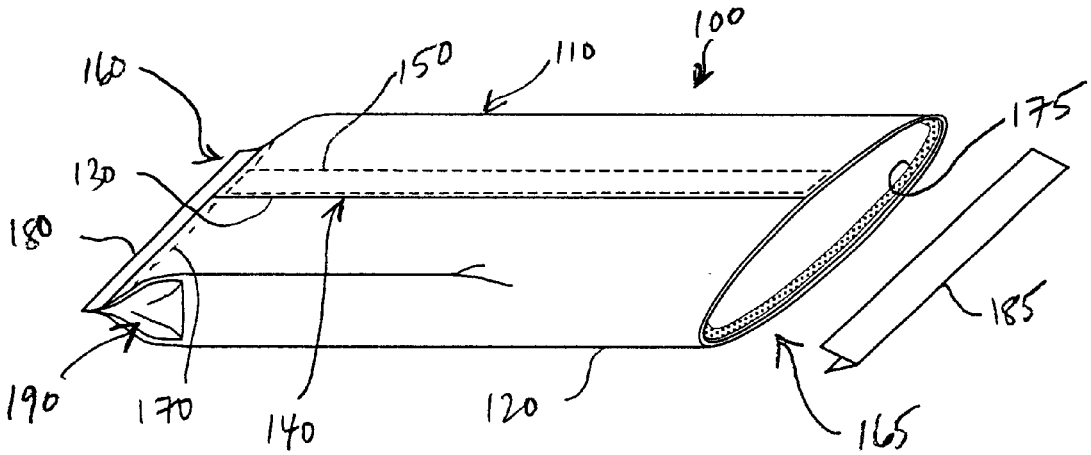
FIG. 2 is a view of the apparatus of FIG. 1 with an element repositioned for illustration purposes.

With reference next to FIG. 2, it can be understood that the container 110 is initially formed with one end 160 closed and the other end 165 open for introduction of the flowable, gelatinous, or powdered substance into the container 110. Thereafter, the open end 165 is sealed with any of the previously described devices and methods, including an adhesive strip such as end seal 175, or end strip 185, or a releasable thermal weld across end 165, or any combination thereof. One suitable method of releasably sealing the open end is described in U.S. Pat. No. 5,823,685, which is incorporated herein by reference in its entirety. The end strips 180, 185 may be formed from a plastic material that can be thermally welded to the open end 165 of the container 110. In the alternative or in combination therewith, the end strips 180,185 may be attached with a releasable adhesive adapted to adhere to and seal the open end 165.

Figure 3:
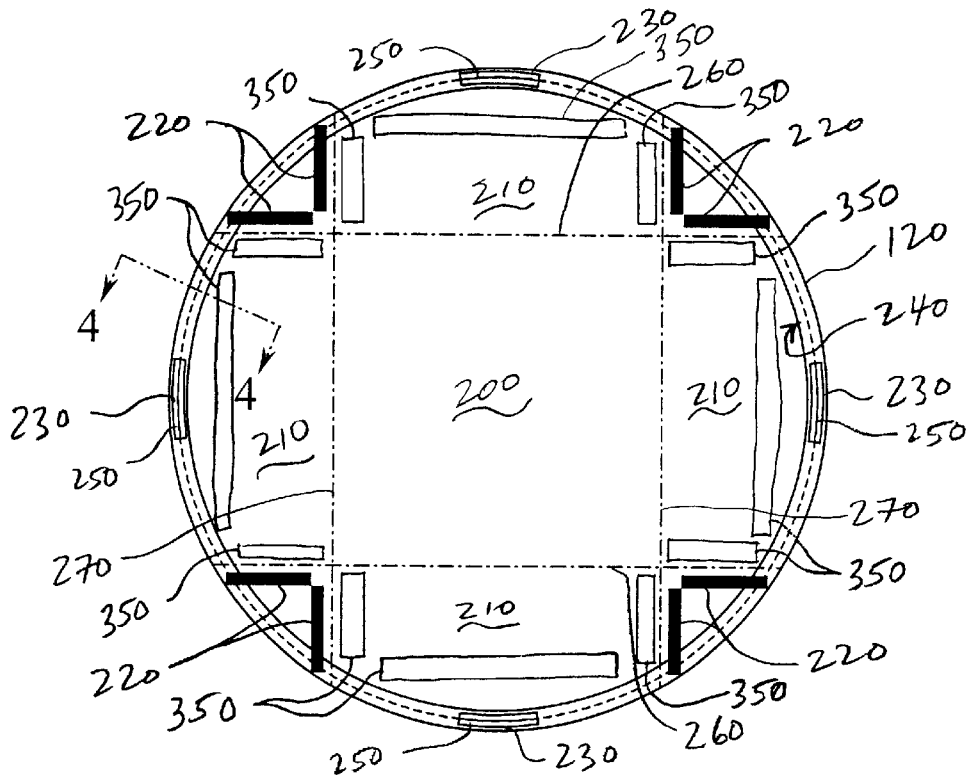
FIG. 3 is a view of the apparatus of FIG. 1 that shows a planform view of the flexible sheet of the container in an unfolded configuration to form a mixing mat.
Figure 4:
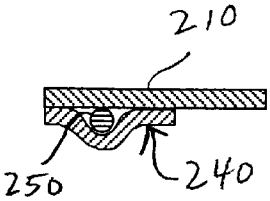
FIG. 4 is a section view of a portion of the periphery of the mixing mat of FIG. 3 taken along section line 4—4.
Figure 5:
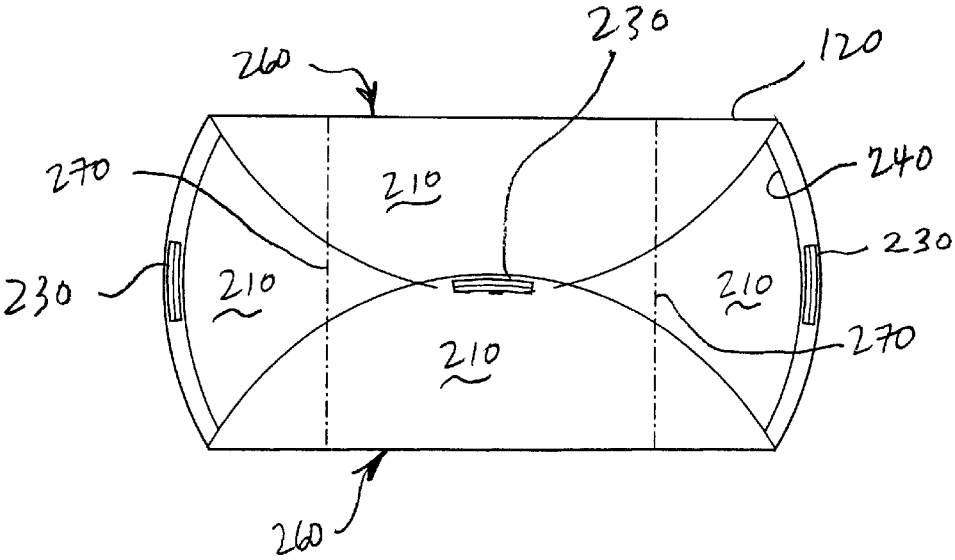
FIG. 5 is a view of the flexible sheet of FIG. 3 shown partially folded.

With reference next to the planform view of FIGS. 3 and 4, the flexible sheet 120 is shown completely unfolded and with all enclosures seams and seals released (but, excluding all fold seams, which are generally only for folding and which do not generally release or open). In this configuration, the sheet 120 is unfolded into a mixing mat that is formed with a basin portion 200 and a circumferential periphery 210 that incorporates at least one releasably engagable basin former 220 and manual mixing handles 230, the latter being formed as apertures in the periphery 210. As also described below, the periphery 210 also may include one or more handles also formed as, for example without limitation, any of a wide variety of suitable handle types (not shown) well-known to the art that may be otherwise attached to the periphery 210 by adhesives, rivets, thermal welds, and some other equally suitable fastening means. Such alternative handles may be included either as an alternative or in combination with the handles 230.

Preferably, the at least one basin former 220 is configured to form the periphery 210 into a vertically projecting circumferential riser (see, for example, FIG. 4) that surrounds the basin portion 200 when the at least one former 220 is engaged. The basin former 220 can be incorporated into the periphery 210 and can incorporate a raceway 240 that is received with a cinch cord or draw string 250 that is operative to form the riser or a surrounding, raised wall when drawn. In the alternative, the periphery may incorporate a plurality of fold seams 260, 270, adapted whereby the periphery 210 is folded about the fold seams 260, 270 to form the riser from opposing walls. The fold lines or seams 260, 270 may be integrally formed into flexible sheet 120 either by thermal forming processes, or by cold working and forming methods, or a combination thereof.

As shown in FIG. 3, the basin formers 220 preferably incorporate any of a variety fasteners, such as, for example, hook and loop fasteners such as Velcro® by DuPont, metal or plastic snaps or zippers (including zippers with interlocking teeth and engagable rails and keyways), twist-lock posts adapted for receipt into corresponding holes, and adhesives that may be applied directly to the surface of the sheet 120 or in the form of adhesive strips that are glued in place and preserved with removable adhesive covers until first use. Such removable adhesive covers are well-known in the art of adhesives manufacturing and are commonly available in consumer goods and retail sales stores, and are incorporated into significant variety of what are commonly referred to as "self-stick" devices and "double-stick" tape and related products.

Figure 6:
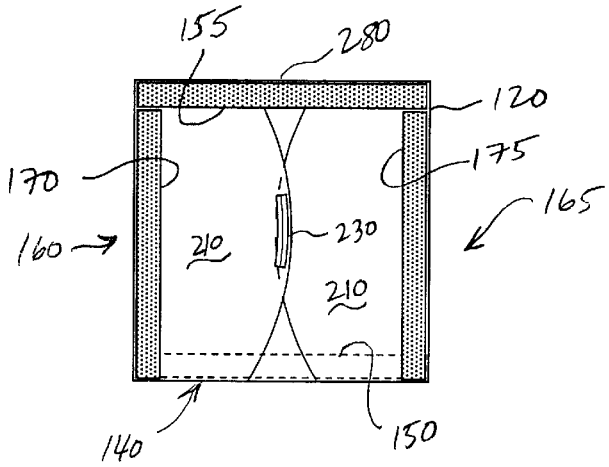
FIG. 6 is a view of the flexible sheet of FIG. 5 shown partially folded.

With reference now also to FIGS. 1, 2, 5, and 6, it can be seen that the container 110 may be formed by folding the flexible sheet along fold seams 260, 270, and then by folding edge 280 down under flexible sheet 120, as shown in FIG. 6, whereby seam seal 155 releasably engages second seam seal 155. In this folding arrangement, the folded over periphery 210 remains on the outside of container 110. This way, the substantially flowable substance contained in the container 110 can be stored against the smooth, unfolded surface of flexible sheet 120. Moreover, the container can be opened by releasing seam 140 while retaining the contents upon the flexible sheet 120 as the periphery 210 is unfolded from beneath the sheet 120 for reconfiguration into a mixing mat 200 and basin 320.

In alternative configurations, the folding edge 280 may be folded up and over the flexible sheet 120, as shown in FIG. 6, whereby seam seal 155 releasably engages second seam seal 155. In this configuration, the folded over periphery 210 is situated within the container 110 and in contact with the substantially flowable substance (not shown). In this arrangement, an additional inner bag (not shown), which can also serve as an added moisture barrier if desired, may be included to contain the substantially flowable substance within the moisture barrier bag or container so as to enable the flexible sheet 120 to be more easily unfolded without prematurely or undesirably displacing the flowable substance. The addition of the complementary inner bag may also be used in any of the preceding variations and embodiments. The added inner bag, while adding some minimal cost, may operate as an added moisture barrier and an added layer of protection against punctures and leaks of material that may otherwise occur if the outer flexible sheet 120 is punctured during storage, handling, and operation. Additionally, the added bag can serve as a measuring device to measure or meter a predetermined or desired amount of the substantially flowable substance and any additives.

Once the flexible sheet 120 is unfolded, the contents of the inner bag may be transferred to the mixing mat portion 200 and then a second substance may be metered into the second bag, which can include calibrated indicia (not shown) analogous to a commonly used kitchen measuring cup to indicate volumetric quantities. In another variation of the various preferred embodiments, an additional outer layer may be employed to cover the container 110 and the flexible sheet 120, which outer layer may serve to add strength and integrity to the container and for advertising and product identification purposes. One type of outer layer presently in use includes what is commonly referred to as a kraft paper layer, or in the alternative, a vinyl outer layer, or both.

Figure 7:
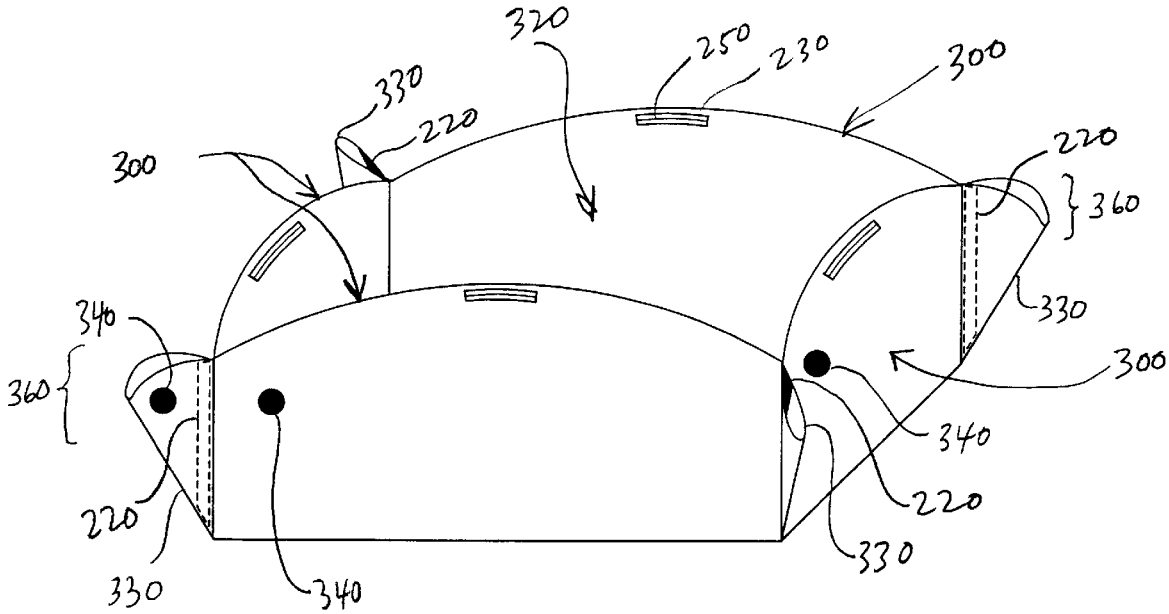
FIG. 7 is an elevated perspective view of the flexible sheet of FIG. 3 shown in operation with opposing walls of the flexible, folded sheet forming a basin for mixing the substantially flowable substance.

With reference now also to FIG. 7, the at least one basin former 220 can be adapted to releasably engage opposing walls 300 to form the riser and basin 320 from the basin portion 200 and the opposing walls 300. Although shown in the figures to incorporate multiple basin formers 220, the present invention has been satisfactorily demonstrated for its intended purposed with a single basin former 220. In this latter configuration, the opposing walls 300 are simply lower than contemplated in FIG. 7. Variations of the embodiments shown also include basin formers 220 of different sizes that can be adjusted to create various heights of the riser walls 300. As seen in FIG. 7, when the flexible sheet 120 is folded to form opposing walls 300, and as basin formers 220 are engaged, corner flaps 330 are formed from the excess portions of the periphery 210 that remain after basin formers 220 are engaged. The flaps 330 may be used in conjunction with the handles 230 or alone in configurations that do not include the handles 230. In the instant variation, the basin former 220 may also be further formed with the raceway 240 that is received with a cinch cord or drawstring 250.

For added convenience during operation of the apparatus 100, such as during mixing, the flaps 330 may be retained against the walls 300 with flap retainers 340. The retainers 340 may for formed from, for example, hook and loop fasteners such as Velcro® by DuPont, metal or plastic snaps or zippers, twist-lock posts adapted for receipt into corresponding holes, and adhesives that may be applied directly to the sheet surface or in the form of adhesive strips that are glued in place.

For purposes of further illustration, but not for limitation, and depending upon the type of substantially flowable substance to be used and the type of operation to be implemented, as well as the selected thickness of the flexible sheet 120, various types of stiffeners, such as stiffeners 350, may be incorporated into or formed upon the flexible sheet 120. The stiffeners 350 may be an added layer of material equivalent in thickness to sheet 120, which is thermoformed, welded, or otherwise adhered to the sheet 120, or they may formed be thicker or thinner materials having a different composition than that of sheet 120. In any implementation, the stiffeners may preferably be foldable and formed with fold seams, such as fold seams 260, 270 so as to facilitate compatibility with forming the container 110. In alternative configurations, the stiffeners 350 may simple be segmented as can be appreciated with reference to the exemplary embodiment depicted in FIG. 3.

Although not shown in the figures, it can be understood with reference thereto that the cinch cord 250, if it is incorporated in a particular variation of the embodiments shown, may be drawn tight to effectively close the upper portion or top, as indicated generally by reference numeral 360 in FIG. 7, of basin 320 so as to keep the flowable substance protected from exterior elements and contaminants. For example, cementitious mixtures that have been hydrated with water or other substances may be kept from prematurely drying and curing. The top 360 can be closed to keep insects and parasites from foodstuffs; and compost can be kept warm and moist for optimal decomposition. Additionally, powered metal and plastic pellets may be kept free from dust and contaminants after mixing and while awaiting sintering and molding, respectively. Also, as a further example, biologically, chemically, and radiation contaminated and hazardous bulk treatment material may be more easily and conveniently retained until disposal or incineration.

In each of the preceding views and figures, which are not depicted to scale or in any specifically accurate proportional representation, a circular shaped flexible sheet 120 is illustrated. However, any of a variety of possible shapes and configurations are equally suitable and are dependent upon the desired mixing or treatment basin configuration as well as the preferred container shape and size, and the type of substantially flowable substance to be contained. Even though a generally bag shaped container 110 is reflected in the description and figures, any of a variety of container shapes are possible, such as, for example, boxes, cylinders, and combinations thereof. Moreover, the arrangement of fold seams 260, 270, handles 230, and stiffeners 350, may be similarly reconfigured to accommodate the preferred shape, size, and proportion of the desired container, and the preferable mixing mat and basin sizes and configuration. It has been found that either the basin, mixing mat, or container preferences are equally suitable starting places for purposes of deriving the possible and most desirable corresponding configuration, placement, and arrangement of the various apparatus elements described above, such as the locations and orientations of the fold and enclosure seams, and other necessary features.

In other variations and modifications of the preferred embodiments, the riser wall and opposing walls 300 can be marked with indicia (not shown) that are calibrated to establish predetermined quantities of the substantially flowable substance, and any added substances. Such markings enable the user to add one or more additional substances to the basin 320 so that a properly proportioned mixture can be obtained. For purposes of manually mixing the charge or contents of the basin 320, the periphery 210 also may include one or more handles formed as, for example without limitation, the previously described apertures 230 into the outer edge of the periphery 210, or any of a wide variety of suitable handle types (not shown) well-known to the art that may be otherwise attached to the periphery 210 by adhesives, rivets, thermal welds, and some other equally suitable fastening means.

In a variation of any of the preceding embodiments, the container 110 may also further incorporate an outside covering (not shown). In this modification, the flexible sheet 120 is folded and arranged to be removably retained within an interstice (not shown) formed between a moisture barrier of the container 110 and an outside covering such as that already described above.

The apparatus 100 may be further modified to incorporate and arrange the folded removable sheet 120 so that it removably and substantially conforms to the profile of the container 110, either inside or outside the moisture barrier contemplated above.

Numerous alterations, modifications, and variations of the preferred embodiments disclosed herein will be apparent to those skilled in the art and they are all contemplated to be within the spirit and scope of the instant invention. For example, although specific embodiments have been described in detail, those with skill in the art will understand that the preceding embodiments and variations can be modified to incorporate various types of substitute and/or additional materials, relative arrangement of elements, and dimensional configurations for compatibility with the wide variety of container filling equipment and bulk, substantially flowable substances available in the industry. Accordingly, even though only few variations of the present invention are described herein, it is to be understood that the practice of such additional modifications and variations and the equivalents thereof, are within the spirit and scope of the invention as defined in the following claims.

I claim:

1. A storage and mixing apparatus for storing and mixing a substantially flowable substance, comprising:

a releasably sealable container formed from a folded flexible sheet incorporating a releasable seal such that when the seal is released the sheet is adapted to unfold about a plurality of fold seams into a mixing mat having a basin portion, the sheet including a periphery that incorporates at least one releasably engagable basin former that is configured to form the periphery into a circumferential riser when the at least one basin former is engaged.

2. The storage and mixing apparatus according to claim 1, wherein the basin former is incorporated into the periphery and is formed with a raceway received with a cinch cord operative to, when drawn, form the riser, which thereby forms and surrounds a basin.

3. The storage and mixing apparatus according to claim 1, wherein the periphery is folded along the plurality of fold seams into opposing walls that form the riser, and wherein the at least one basin former is adapted to releasably engage the opposing walls to form a basin from the basin portion and the opposing walls.

4. The storage and mixing apparatus according to claim 3, wherein the opposing walls are releasably engaged by the at least one basin former, which incorporates at least one fastener selected from the group including hooks and loops, snaps, zippers, twist-lock posts adapted for receipt into corresponding holes, and adhesives.

5. The storage and mixing apparatus according to claim 4, wherein the opposing walls include indicia calibrated to establish a predetermined quantity of the combination of the substantially flowable substance and a second substance, when both substances are contained within a basin formed by the opposing walls and the basin portion of the mixing mat.

6. The storage and mixing apparatus according to claim 1, wherein the container is created by folding the flexible sheet about the fold seams to form releasably sealable enclosure seams, and whereby the container is thereby adapted to store and contain the substantially flowable substance when the sheet is in the folded configuration.

7. A storage and mixing apparatus for storing and mixing a first substantially flowable substance with a second substance, comprising:

a flexible releasably sealable container formed with a moisture barrier and incorporating a releasable seal such that the container is adapted to contain the first substance; and a releasably sealable folded flexible sheet forming the moisture barrier and being removably and conformally arranged about the container, the sheet having a basin portion and being adapted to unfold along a plurality of fold seams into a mixing mat that includes a periphery having at least one releasably engagable basin former, the periphery being configurable to form a riser when the at least one basin former is engaged.

8. The storage and mixing apparatus according to claim 7, wherein the container bears indicia calibrated to measure a predetermined quantity of the second substance received therein.

9. The storage and mixing apparatus according to claim 8, wherein the indicia are calibrated to measure the second substance before removal of the first substance from the container.

10. The storage and mixing apparatus according to claim 9, wherein the basin former is incorporated into the periphery and is formed with a raceway received with a cinch cord operative to, when drawn, form the riser, which thereby forms and surrounds a basin.

11. The storage and mixing apparatus according to claim 9, wherein the container further incorporates an outside covering and wherein the folded flexible sheet is configured to be retained within an interstice formed between the moisture barrier of the container and the outside covering.

12. The storage and mixing apparatus according to claim 11, wherein the basin former is incorporated into the periphery and is formed with a raceway received with a cinch cord operative to, when drawn, fold the periphery along the plurality of fold seams into opposing walls that form the riser, and wherein the at least one basin former is further adapted to releasably engage the opposing walls to form a basin from the basin portion and the opposing walls.

13. The storage and mixing apparatus according to claim 11, wherein the periphery incorporates a plurality of fold seams adapted whereby the periphery is folded into opposing walls that form the riser, and wherein the at least one basin former is adapted to releasably engage the opposing walls to form a basin from the basin portion and the opposing walls.

14. The storage and mixing apparatus according to claim 13, wherein the opposing walls are releasably engaged by the at least one basin former, which incorporates at least one fastener selected from the group including hooks and loops, snaps, zippers, twist-lock posts adapted for receipt into corresponding holes, and adhesives.

15. A storage and mixing apparatus for storing and mixing a substantially flowable substance, comprising:

a flexible releasably sealable container formed with a moisture barrier and incorporating a releasable seal such that the container is adapted to contain a predetermined amount of the substantially flowable substance; and a releasably sealable folded flexible sheet that removably and substantially conforms to the container profile and that is adapted to unfold about a plurality of fold seams into a mixing mat configured with a basin portion, the sheet including a periphery that incorporates at least one basin former that is configured to form the periphery into a circumferential riser when the at least one basin former is engaged.

16. The storage and mixing apparatus according to claim 15, wherein the basin former is incorporated into the periphery and is formed with a raceway received with a cinch cord operative to, when drawn, form the riser, which thereby forms and surrounds a basin.

17. The storage and mixing apparatus according to claim 15, wherein the periphery is folded along the plurality of fold seams into opposing walls that form the riser, and wherein the at least one basin former is adapted to releasably engage the opposing walls to form a basin from opposing walls and the basin portion.

18. The storage and mixing apparatus according to claim 17, wherein the opposing walls include indicia calibrated to establish a predetermined quantity of the substantially flowable substance and a second substance contained within a basin formed by the opposing walls and the basin portion of the mixing mat.

19. The storage and mixing apparatus according to claim 17, wherein the opposing walls are releasably engaged by the at least one basin former that incorporates at least one fastener selected from the group including hooks and loops, snaps, zippers, twist-lock posts adapted for receipt into corresponding holes, and adhesives.

20. The storage and mixing apparatus according to claim 17, wherein the basin former that is incorporated into the periphery is further formed with a raceway received with a cinch cord.

* * * * *